US006082135A

United States Patent [19]

Duke et al.

[11] Patent Number: 6,082,135

[45] Date of Patent: Jul. 4, 2000

[54] AIR SEPARATION METHOD AND APPARATUS TO PRODUCE AN OXYGEN PRODUCT

[75] Inventors: Robert F. Duke, Bridgewater; Joseph P. Naumovitz, Lebanon; Charles Brooks, North Plainfield, all of N.J.

[73] Assignee: The BOC Group, Inc., New Providence, N.J.

[21] Appl. No.: 09/240,025

[22] Filed: Jan. 29, 1999

[51] Int. Cl.[7] ..... F25J 1/00

[52] U.S. Cl. ..... 62/646; 62/654; 62/913

[58] Field of Search ..... 62/646, 654, 913

[56] References Cited

U.S. PATENT DOCUMENTS

| | | | |
|---|---|---|---|
| 4,732,595 | 3/1988 | Yoshino | 62/913 |
| 5,084,081 | 1/1992 | Rohde | 62/913 |
| 5,505,052 | 4/1996 | Ekins et al. | 62/913 |
| 5,596,885 | 1/1997 | Grenier | 62/913 |

*Primary Examiner*—Ronald Capossela
*Attorney, Agent, or Firm*—Salvatore P. Pace

[57] ABSTRACT

A method and apparatus for separating out is used to produce an oxygen product in which an air stream after having been compressed and purified is introduced into a bottom reblower located in a bottom region of the distillation column to produce boil up in such distillation column. The resultant air stream liquefies to produce a liquid air stream. The liquid air stream after having been valve expanded is stripped within the distillation column to produce a column bottoms which can be extracted as a product stream that is vaporized within a main heat exchanger. Product stream can be pressurized by being pumped to atmospheric a pressure hence liquefying a further compressed air stream to produce further liquid air is also stripped within the distillation column. The distillation column operates at near atmospheric pressures that is pressures between 1 and 1.3 bar absolute. Refrigeration is introduced into the plant by injecting liquid preferably liquid oxygen into a bottom region of the distillation column.

12 Claims, 1 Drawing Sheet

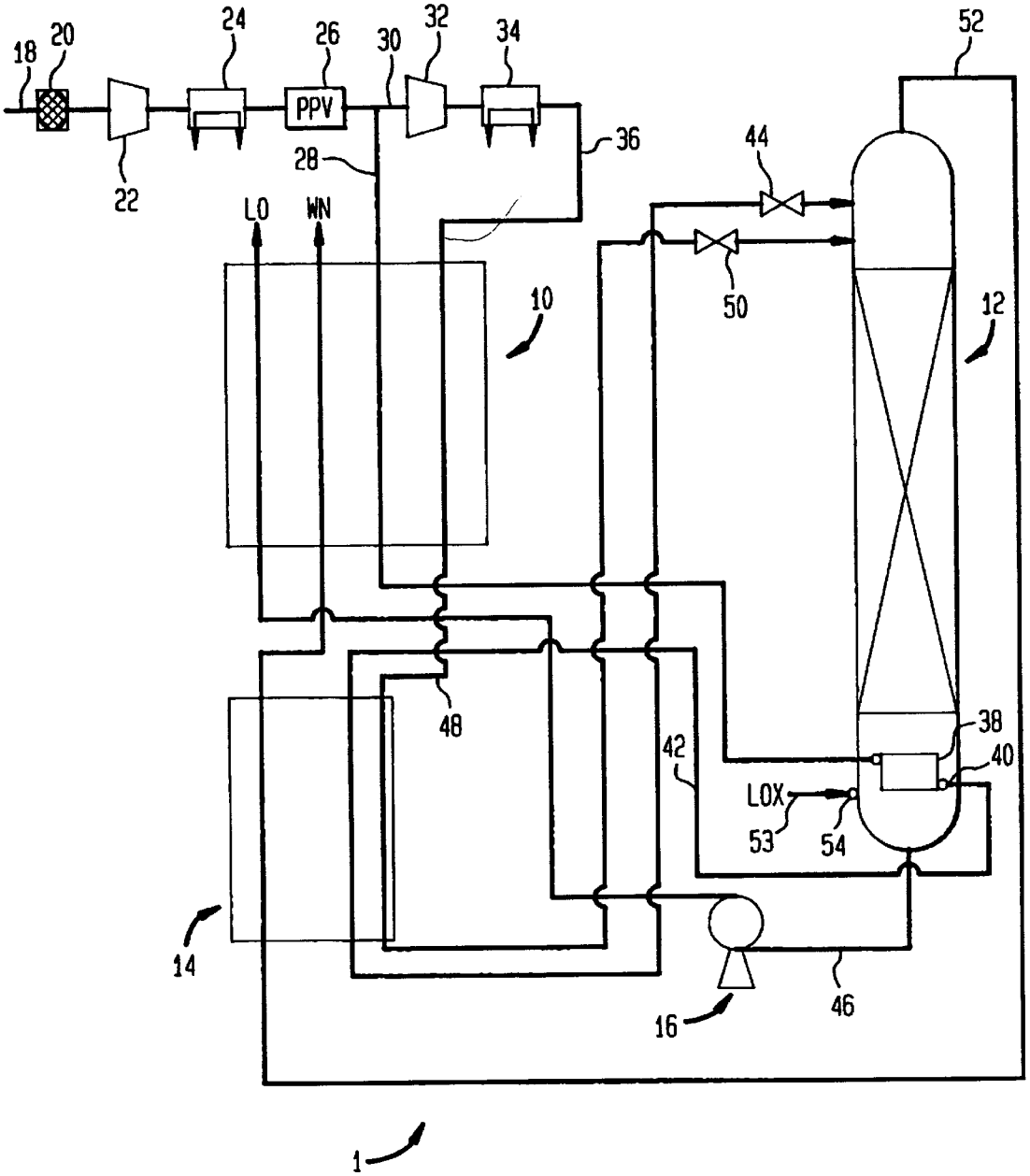
18
20
22
24
26
PPV
30
32
34
36
28
52
44
50
LO
WN
10
12
48
42
38
40
LOX
53
54
14
16
46
1

AIR SEPARATION METHOD AND APPARATUS TO PRODUCE AN OXYGEN PRODUCT

BACKGROUND OF THE INVENTION

The present invention relates to a method and apparatus for separating air to produce an oxygen product in which air is stripped within a distillation column operating at or near atmospheric pressure. More particularly, the present invention relates to such a method and apparatus in which the air is liquefied in a bottom reboiler of the distillation column. Even more particularly, the present invention relates to such a method and apparatus in which refrigeration is supplied by a liquid assist stream.

Air can be separated by a process known as cryogenic rectification to produce an oxygen product. One manner of conducting such a process is to separate compressed and purified air in a double distillation column unit. In such a distillation column unit, crude liquid oxygen is formed as a column bottoms of a higher pressure column. This crude liquid is further refined in a lower pressure column to produce the liquid oxygen product as a column bottoms. A product stream, withdrawn from the lower pressure column, is vaporized within a main heat exchanger that is initially used to cool the air. In order to produce the oxygen at pressure, the oxygen may be pumped prior to being vaporized.

As an alternative to a double distillation column unit, the compressed and purified air, after having been cooled, is introduced into an intermediate location of a single column. The oxygen forms as a bottoms product. This bottoms product is vaporized in a head condenser of the column. The resultant oxygen vapor may then be cold compressed. Part of the cold compressed vapor is returned to the column and a remaining part is warmed in the main heat exchanger to form the oxygen product.

In both of the double and single column arrangements, a sizable portion of the fabrication costs result from column construction. In case of double column plants, two columns are fabricated. In case of a single column plant, although there is a single column, such single column can more properly be visualized as a column having an additional lower section to separate the oxygen from the nitrogen. Additionally, in both types of systems, refrigeration is provided by machinery such as turbo expanders to maintain the plant in heat balance.

As will be discussed, the present invention provides a method and apparatus for producing an oxygen product in which the plant fabrication costs are less than those involved in fabricating both double and single column air separation plants of the prior art.

SUMMARY OF THE INVENTION

The present invention relates to a method of separating air to produce an oxygen product. In accordance with such method, a compressed purified air stream is cooled. Boil-up is produced within a distillation column operating at an operational pressure in a range of between about 1 and about 1.4 atmospheres. The boil-up is produced by indirectly transferring heat between the compressed and purified air stream and a column bottoms of the distillation column. As a result of such heat exchange, the compressed and purified air stream liquefies to form a liquid air stream. The liquid air stream is valve expanded to the operational pressure of the distillation column and the liquid air contained within the liquid air stream is stripped within the distillation column, thereby forming an oxygen-enriched liquid column bottoms and a nitrogen-enriched tower over head. Refrigeration is supplied by cryogenic liquid assist and a product stream composed of the column bottoms is vaporized thereby, to produce the oxygen product. In this regard, such cryogenic liquid assist may be effectuated by introducing a cryogenic liquid such as liquid oxygen into the distillation column.

In another aspect, the present invention provides an apparatus for separating air to produce an oxygen product. In accordance with this aspect of the present invention, a main heat exchanger is provided that is configured to cool a compressed and purified air stream and to vaporize a product stream. A distillation column is also provided having a bottom reboiler to produce boil-up therewithin. The bottom reboiler is associated with the distillation column so that the compressed and purified air stream liquefies against boiling the column bottoms to form a liquid air stream. The bottom reboiler is connected to the main heat exchanger so that the compressed and purified air stream liquefies to form a liquid air stream. The distillation column is also connected to the bottom reboiler to receive the liquid air stream and so that the air is stripped, thereby to form an oxygen-enriched liquid as a column bottoms and a nitrogen-enriched tower overhead. An expansion valve is imposed between the main heat exchanger and the distillation column so that liquid air stream is expanded to a near atmospheric operational pressure. The distillation column has a liquid assistant inlet for introducing a cryogenic liquid into the distillation column to supply refrigeration. The main heat exchanger is connected to the distillation column so that the products formed from the column bottoms are vaporized therein to produce the oxygen product.

On average, a distillation column, of the present invention operates at a lower pressure than the prior art. Since the air pressure is lower, the relative volatility between oxygen and nitrogen is increased and therefore, fewer stages of separation need be provided. This allows the column to be more compactly fabricated than prior art columns and therefore at lower fabrication costs. For instance, in the double column arrangement since the higher pressure is made to operate between 5 and 6 bars absolute, only a crude liquid can be formed. The lower pressure column, normally operating at about 1.2 bars absolute, allows the oxygen to more completely separate from the nitrogen. The resulting size of the double column is therefore greater than that of the present invention. In a single column, again, the column operates at higher pressure and therefore requires more stages and a greater column height than a column used in the present invention.

A further point here is that since the column is operating at nearly atmospheric pressure, a turboexpander is not be used to provide refrigeration because a column stream formed of waste or nitrogen used for such purpose would have to be expanded to below atmospheric pressure. The present invention, in place of the turboexpander, uses liquid assist by a cryogenic liquid stream which is preferably liquid oxygen introduced into the bottom region of the column. The liquid assist stream can also be nitrogen or liquid air injected near the top of the column. However, a turboexpander, an expensive machine, is not used to further lower capital construction costs.

BRIEF DESCRIPTION OF THE DRAWINGS

While the specification includes with claims distinctly pointing at the subject matter that Applicants regard a certain invention, is believed that the invention will be better understood when taken in connection with the sole FIGURE which is a schematic diagram of an apparatus for carrying out a method in accordance with the present invention.

DETAILED DESCRIPTION

With reference to the FIGURE, an air separation apparatus 1, in accordance with the present invention is illustrated for producing a gaseous oxygen product labeled "GO". Compressed and purified air is cooled within a main heat exchanger 10 is liquefied and stripped within a distillation column 12. A subcooling unit 14 is provided to subcool further compressed air for stripping within distillation column 12. The further compressed air is provided for vaporizing a liquid pressurized by a pump 16. This vaporized liquid is used to form the gaseous oxygen product.

Having generally described apparatus 1, in more detail description follows with a description of the processing of the incoming air. An air stream 18 is filtered in a filter 20 and then compressed by a main air compressor 22. After the heat of compression is removed by an after-cooler unit 24, which may be water cooled, the air is then purified within a prepurification unit 26. Prepurification unit 26 may be absorbent beds containing alumina and the like to remove moisture from a carbon dioxide and some heavy hydrocarbons from the air. Such adsorbent beds, as known in the art, are operated out of phase so that one bed is online and purifying the air while the other bed or beds is being regenerated. The resultant compressed and purified air is divided into a compressed and purified air stream 28 and another compressed and purified air stream 30 which is further compressed by a booster compressor 32 or a booster section of a single compressor. The heat of compression is removed from the further compressed air by another after-cooler unit 34 to produce a further compressed and purified air stream 36.

Compressed and purified air stream 28 is cooled within main heating exchanger 10 and then introduced into a bottom reboiler 38 provided a bottom region 40 of distillation column 12. Distillation column 12 is provided with mass transfer elements such as structured packing, random packing, or sieve trays. Such mass transfer elements are employed to bring ascending vapor and descending liquid phases into intimate contact. This results in the vapor phase becoming ever more enriched in nitrogen and the liquid phase becoming ever more enriched in oxygen.. In order to initiate the formation of the vapor phase, an oxygen-enriched column bottoms, produced within distillation column 12, is reboiling by reboiler 38. The compressed and purified air stream due to such heat exchange liquefies to produce a liquid air stream 42. Liquid air stream 42 is subcooled within subcooling unit 14 and then valve expanded by an expansion valve 44 to the operational pressure of distillation column 12. This operational pressure, is a near atmospheric pressure as has been described above. The liquid contained within liquid air stream 42 is then stripped within distillation column 12 to produce the oxygen-enriched column bottoms and the nitrogen-enriched tower overhead.

The further compressed air stream 36 liquefies within main heat exchanger 10 and a product stream 46 is pumped by pump 16 for pressurization purposes. Product stream 46 is vaporized within main heat exchanger 10 causing liquefaction of the further compressed air stream 36. After the liquefaction, a further liquid stream 48 is formed that also is subcooled within subcooling unit 14. Further liquid stream 48 is valve expanded, by expansion valve 50, and the resultant stream also introduced into the top of distillation column 12 so that the liquid air contained within is also stripped with in distillation column 12. In addition to the foregoing, a waste nitrogen stream, labeled "WN" and designated by reference numeral 52, is used to sub cool liquid air stream 28 and further liquid air stream 48. Waste nitrogen stream 52 fully warms within main heat exchanger 10.

In order to keep this separation apparatus 1 in a heat balance, liquid oxygen is injected as a liquid cryogen stream 53 into bottom region 40 of distillation column 12. A nozzle 54 is provided for such purpose.

As may be appreciated by the skilled in the art, if a gaseous oxygen product were to be utilized at or close to atmospheric pressure, then pump 16 and the equipment used in forming further compressed air stream 36 would not be present. In addition, other types of liquid assists are known such as injecting liquid nitrogen. The present invention could also be used in connection with a liquid nitrogen assist introduced into the top of the column.

While the present invention has been described with reference to preferred embodiment, as will occur to the skilled in the art, numerous changes, additions, and omissions may be made without departing from the spirit and scope of the present invention.

We claim:

1. A method of separating air to produce an oxygen product, said method comprising:

cooling a compressed and purified air stream;

producing boil-up within a distillation column, operating at an operational pressure in a range of between about 1 and about 1.4 atmospheres absolute, by indirectly transferring heat between said compressed and purified air stream and a column bottoms of said distillation column so that said compressed and purified air stream liquefies to form a liquid air stream;

valve expanding said compressed and purified air stream to said near atmospheric operational pressure;

stripping the liquid air contained within said liquid air stream within said distillation column, thereby to form an oxygen-enriched liquid as said column bottoms and a nitrogen-rich tower overhead;

supplying refrigeration by cryogenic liquid assist; and vaporizing a product stream composed of said column bottoms, thereby to produce said oxygen product.

2. The method of claim 1, further comprising:

pumping said product stream;

liquefying a further compressed and purified air stream to form a further liquid air stream;

valve expanding said further liquid air stream to said near atmospheric operation pressure; and stripping the air contained within said further liquid air stream within said distillation column.

3. The method of claim 2, wherein a waste nitrogen stream composed of said nitrogen-rich tower overhead warms and said product stream vaporizes through indirect heat exchange with said compressed and further compress and purified air streams.

4. The method of claim 3 wherein said liquid air stream and said further liquid air stream are subcooled through indirect heat exchange with said waste nitrogen stream and prior to their valve expansion.

5. The method of claim 1 or claim 4, wherein said cryogenic liquid assist is effectuated by introducing a cryogenic liquid into said distillation column.

6. The method of claim 5, wherein said cryogenic liquid comprises liquid oxygen.

7. An apparatus for separating air to produce an oxygen product, said apparatus comprising:

a main heat exchanger configured to cool a compressed and purified air stream and to vaporize a product stream;

a distillation column having a bottom reboiler to produce boil-up therewithin said bottom reboiler associated with said distillation column so that said compressed and purified air stream liquefies therein to form a liquid air stream;

said distillation column connected to said bottom reboiler to receive said liquid air stream and to strip the air contained therewithin, thereby to form an oxygen-enriched liquid as a column bottoms and a nitrogen-rich tower overhead;

an expansion valve interposed between said bottom reboiler and said distillation column so that said compressed and purified air stream is expanded to a near atmospheric operational pressure;

said distillation column having a liquid assist inlet for introducing a cryogenic liquid into said distillation column to supply refrigeration; and said main heat exchanger also connected to said distillation column so that said product stream forms from said column bottoms and when vaporized produces said oxygen product.

8. The apparatus of claim 6, further comprising:

a pump interposed between said main heat exchanger and said distillation column to pump said product stream;

said main heat exchanger is configured to also cool and liquefy a further compressed and purified air stream, thereby to form a further liquid air stream;

said distillation column is connect to said main heat exchanger to receive said further liquid air stream so that the air contained therewith is stripped; and another expansion valve interposed between said distillation column and said main heat exchanger to expand said further compressed and purified air stream to said near atmospheric operation pressure.

9. The apparatus of claim 7, wherein said main heat exchanger is also configured to warm a waste nitrogen stream composed of said nitrogen-rich tower overhead.

10. The apparatus of claim 9 further comprising a subcooler to indirectly heat between said waste nitrogen stream and said liquid air and said further liquid air streams so that said liquid air and said further liquid air streams subcool.

11. The apparatus of claim 7, wherein said liquid assist inlet is located on said distillation column so as to receive liquid oxygen as said cryogenic liquid.

12. The apparatus of claim 10, wherein said liquid assist inlet is located on said distillation column so as to receive liquid oxygen as said cryogenic liquid.

* * * * *